United States Patent [19]

Sasage et al.

[11] Patent Number: 4,541,624

[45] Date of Patent: Sep. 17, 1985

[54] FLAT ARTICLE FEEDING APPARATUS

[75] Inventors: Tsutomu Sasage; Tomohisa Yoshida; Toshio Yoshida, all of Tokyo, Japan

[73] Assignee: Nippon Electric Co., Ltd., Tokyo, Japan

[21] Appl. No.: 478,628

[22] Filed: Mar. 23, 1983

[30] Foreign Application Priority Data

Mar. 24, 1982 [JP] Japan ..... 57-41316[U]
Mar. 30, 1982 [JP] Japan ..... 57-45049[U]

[51] Int. Cl.[4] ..... B65H 5/08

[52] U.S. Cl. ..... 271/12; 198/460; 198/572; 271/94; 271/96; 271/110; 271/265; 271/270

[58] Field of Search ..... 271/10–13, 271/15–17, 2, 94, 96, 34, 35, 110, 111, 270, 265, 258, 259; 198/460, 572, 689

[56] References Cited

U.S. PATENT DOCUMENTS 3,604,702 9/1971 Katagiri et al. ..... 271/94
4,318,540 3/1982 Paananen et al. ..... 271/270
4,331,328 5/1982 Fasig ..... 271/270

*Primary Examiner*—Bruce H. Stoner, Jr.
*Assistant Examiner*—John A. Carroll
*Attorney, Agent, or Firm*—Laff, Whitesel, Conte & Saret

[57] ABSTRACT

A system for feeding a flat article has a suction chamber; a suction belt for picking up one of a plurality of flat articles which are stacked in a vertically standing state. The suction belt moves along the front surface of the suction chamber. The flat articles are carried over a transport path by the suction belt. At an upstream position in the transport path, the intervals between the flat articles are detected. First and second motors drive the suction belt, varying the rotational motor speeds. A roller along the transport path contacts the transferred flat articles in accordance with the interval which is detected by the detecting member.

10 Claims, 9 Drawing Figures

FLAT ARTICLE FEEDING APPARATUS

BACKGROUND OF THE INVENTION

This invention relates to an apparatus for processing a plurality of flat articles, such as envelops and postcards, and more particularly to an apparatus for feeding flat articles, one by one.

A feed apparatus of this kind is utilized, for example, in a mail sorting system. A plurality of flat articles (such as postcards and envelopes) are arranged in a stacker and are fed one by one to an address reading section and a sorting section. There are two feeding modes, i.e., a front-aligned feeding mode, in which a plurality of flat articles are arranged with their front ends aligned are fed one by one, and a rear-aligned feeding mode, in which a plurality of flat articles are arranged with their rear ends aligned are fed one by one. The front-aligned are feeding mode is often employed in the case where a plurality of flat articles stacked in a horizontal state are fed one by one. The rear-aligned feeding mode is used in the case where a plurality of flat articles are stacked in a vertically standing state and are fed one by one.

The flat articles are preferably fed in such a manner that they are spaced from one another by the shortest possible distance, in order to make the most efficient use of a subsequent processing section. On the other hand, such flat articles, to be processed, have various sizes. In order to feed flat articles one by one at a regular pitch, in either the front-aligned feeding mode or the rear-aligned feeding mode, it is necessary to set the regular pitch to a suitable level, taking the size of the largest flat article into consideration. If the regular pitch is set in this manner, the flat articles are necessarily fed at unduly long intervals when there is a high percentage of smaller-sized flat articles.

In the front-aligned feeding mode, the flat articles are practically fed in such a manner that they are spaced from one another by the shortest permissible distance. The next subsequent flat article is delivered, for feeding when a predetermined period of time has elapsed after the detection of a rear end of a previously-fed flat article. Therefore, the flat articles can be fed easily, at the possible shortest interval. As mentioned above, the front-aligned feeding mode is used frequently when flat articles stacked in the horizontally state are fed. However, the flat articles stacked in a vertically standing state can not be fed at the possible shortest interval. In this case, i.e., in the rear-aligned mode, an interval does not become constant between each of the adjacent flat articles, even if a subsequent flat article is delivered for feeding when a predetermined period of time had elapsed, after a front end of a previously-fed flat article was detected.

Accordingly, when the plurality of flat articles are arranged in a vertically standing state and are fed in the rear-aligned mode, the capacity of a subsequent processing section cannot be fully utilized since flat articles cannot be fed as they are kept spaced at the possible shortest interval.

SUMMARY OF THE INVENTION

Therefore, it is an object of the present invention to provide a flat article feeding apparatus which is capable of feeding flat articles one by one while keeping a constant interval between flat articles as they are fed out and the shortest possible interval even when these flat articles are arranged in the rear end-aligned state.

According to a first feature of the present invention, a flat articles feeding apparatus has a vacuum suction chamber with its suction belt moving along a front surface. The belt has suction bores and is adapted to pickup a flat article and to deliver it into a transport path at the output of the suction belt. A first veriable speed motor is adapted to drive the suction belt. An interval is detected between flat articles as they are fed to the transport path. A correction roller is provided in a position which is close to the transport path and is adapted to correct the intervals between the flat articles as they are fed out. A second variable speed motor is adapted to drive the correction roller. The speeds of the first and second motors are controlled in accordance with an output from the detecting means.

According to a second feature of the present invention, a flat article feeding apparatus has a vacuum suction chamber with a suction belt moving along a front surface of the suction chamber. The belt has suction bores spaced at a regular interval. A variable speed motor is adapted to drive the suction belt. The intervals between the flat articles are detected and the speed of the variable speed motor is controlled in accordance with an output of the detecting means.

DESCRIPTION OF THE PREFERRED EMBODIMENTS

Figure 1:
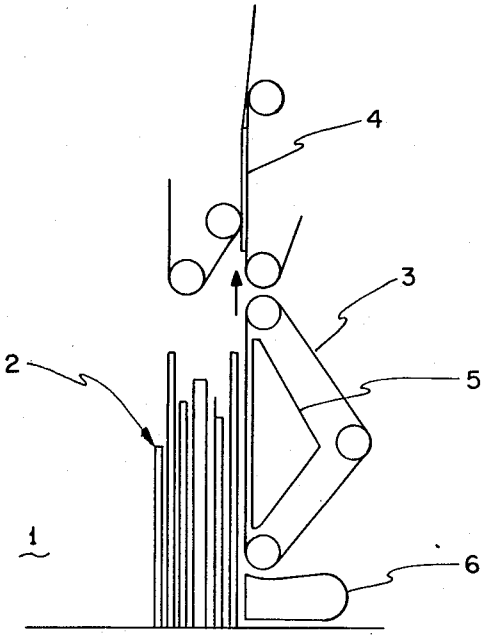
FIG. 1 PRIOR ART
FIG. 1 illustrates a conventional flat article feeding apparatus.

First, in order to make the present invention understood easily, a conventional flat article feeding apparatus will be described. This apparatus is adapted to send out, one by one, a plurality of flat articles arranged with their rear ends aligned. Referring to FIG. 1, a plurality of flat articles 2 are stacked in a vertically standing state with their rear ends aligned in a stacker 1. The extreme right one of the flat articles, among the stacked articles 2, is picked up by a suction belt 3, which has suction bores, to be sent out in the direction of an arrow toward a transport path 4. A suction chamber 5 supplies a vacuum on the inner side of the suction belt 3. An auxiliary suction chamber 6 attracts and holds a flat article, which is immediately after the flat article that is just sent out, to prevent two flat articles being simultaneously fed. Chamber 6 is below the suction chamber 5. When the suction belt 3 is driven at a constant pitch, the flat articles can be fed with a constant interval between the rear ends of two adjacent flat articles. However, since the lengths of the flat articles stacked in the stacker 1 are not the same, there is not a constant distance between a rear end of a flat article sent out previously and a front end of the next subsequent sent out flat article, i.e., an interval between two flat articles is not kept constant.

Figure 2:
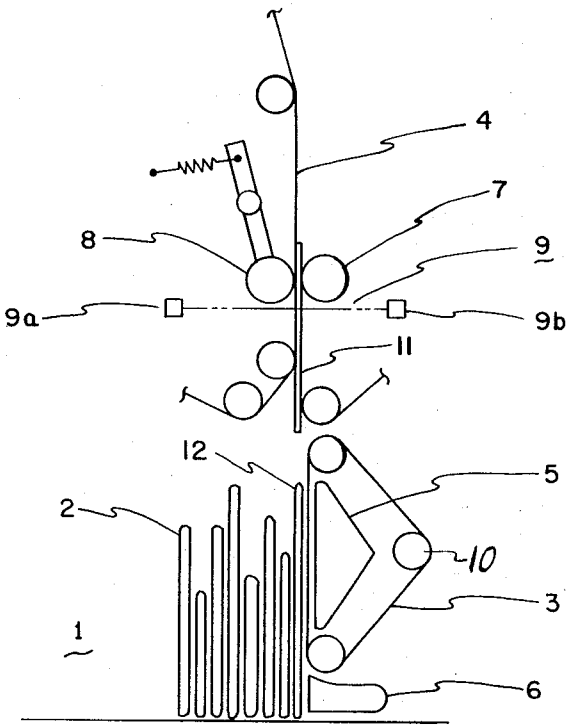
FIG. 2 illustrates a first embodiment of the present invention.

Referring to FIG. 2 showing a first embodiment of the present invention, interval correction means is provided in a transport path 4, through which flat articles are transferred. This interval correcting means includes an interval correction roller 7, an idler roller 8 engaged with the roller 7, a flat article detector 9, variable speed motors $M_1$ and $M_2$ (shown in FIG. 4) for driving the interval correction roller 7 and a suction belt 3, and a control unit for controlling the speed-variable motors $M_1$ and $M_2$ (not shown in FIG. 2). The transport path 4 includes at least a pair of transfer belts and guide rollers. The flat articles are transferred as they are sandwiched between the transfer belts. The interval correction roller 7 is located at an inlet portion of the transport path 4 where the roller 7 does not contact the transfer belts. In addition, a spring urges the idler roller 8 to engage the interval correction roller 7 with a suitable contact pressure. The interval correction roller 7, and a roller 10 for driving the suction belt 3, are connected directly to output shafts of the speed-variable servomotors $M_1$ and $M_2$, respectively.

In the embodiment of FIG. 2, the friction for holding the article between the interval correction roller 7 and the idler roller 8 is higher than the friction for holding the article between the transport belts. Therefore, when the feed rates of the transport belts and the peripheral speed of the interval correction roller 7 are different, the flat article is transferred in accordance with the peripheral speed of the correction roller 7. The speed of the transfer belts is always constant (Vc), and the speed of the suction belt 3 and the peripheral speed of the interval correction roller 7 are normally equal to the speed Vc of the transfer belts. A detector is located before the interval correction roller 7, and consists of a light source **9*a* and a photoelectric conversion element 9*b*, which are opposed to each other to monitor the passage of articles in the transport path 4**.

When the detector 9 finds that the interval is longer than a predetermined shortest (minimum) interval $L_{min}$ between two adjacent flat articles, the interval correction roller 7 is rotated at a high speed for a certain period of time to accelerate an articles movement in the transport path and thereby set the interval to the shortest interval $L_{min}$. Consequently, the flat article 11 is transferred at the higher speed to reduce the mentioned interval by a certain amount $\alpha$. At the same time, the suction belt 3 is also driven at the higher speed for the certain period of time to advance the flat article 12, which is the next subsequent article that is following the flat article 11 being transferred at the high speed. The article 12 is thus advanced by a distance equal to the amount $\alpha$, corrected by the correction roller 7. As a result, the interval between two adjacent flat articles on the downstream side of the interval correction roller 7 can always be kept at the minimum interval $L_{min}$.

Figure 4:
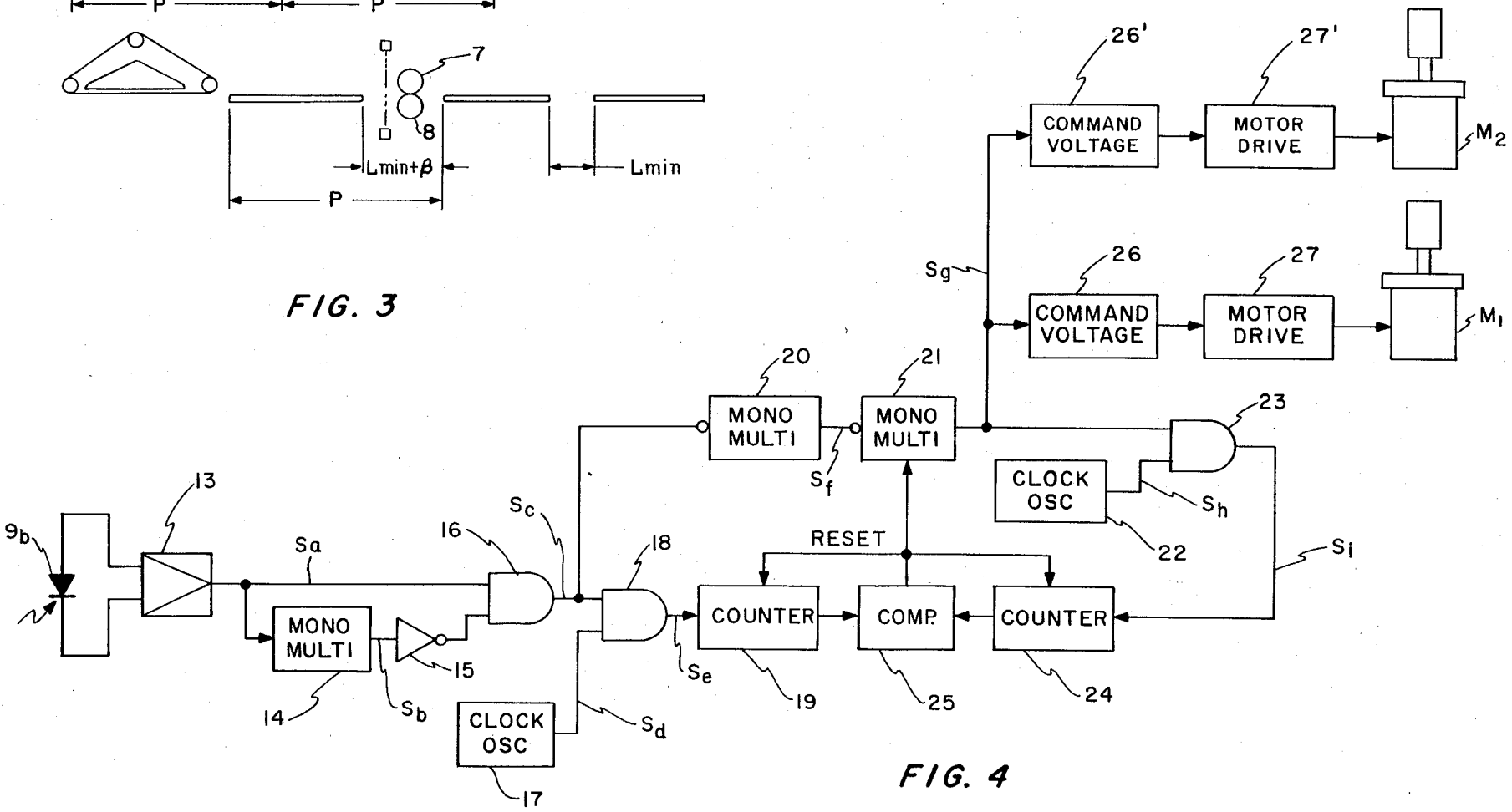
FIG. 4 is a block diagram of a control unit in the first embodiment shown in FIG. 2.
Figure 5:
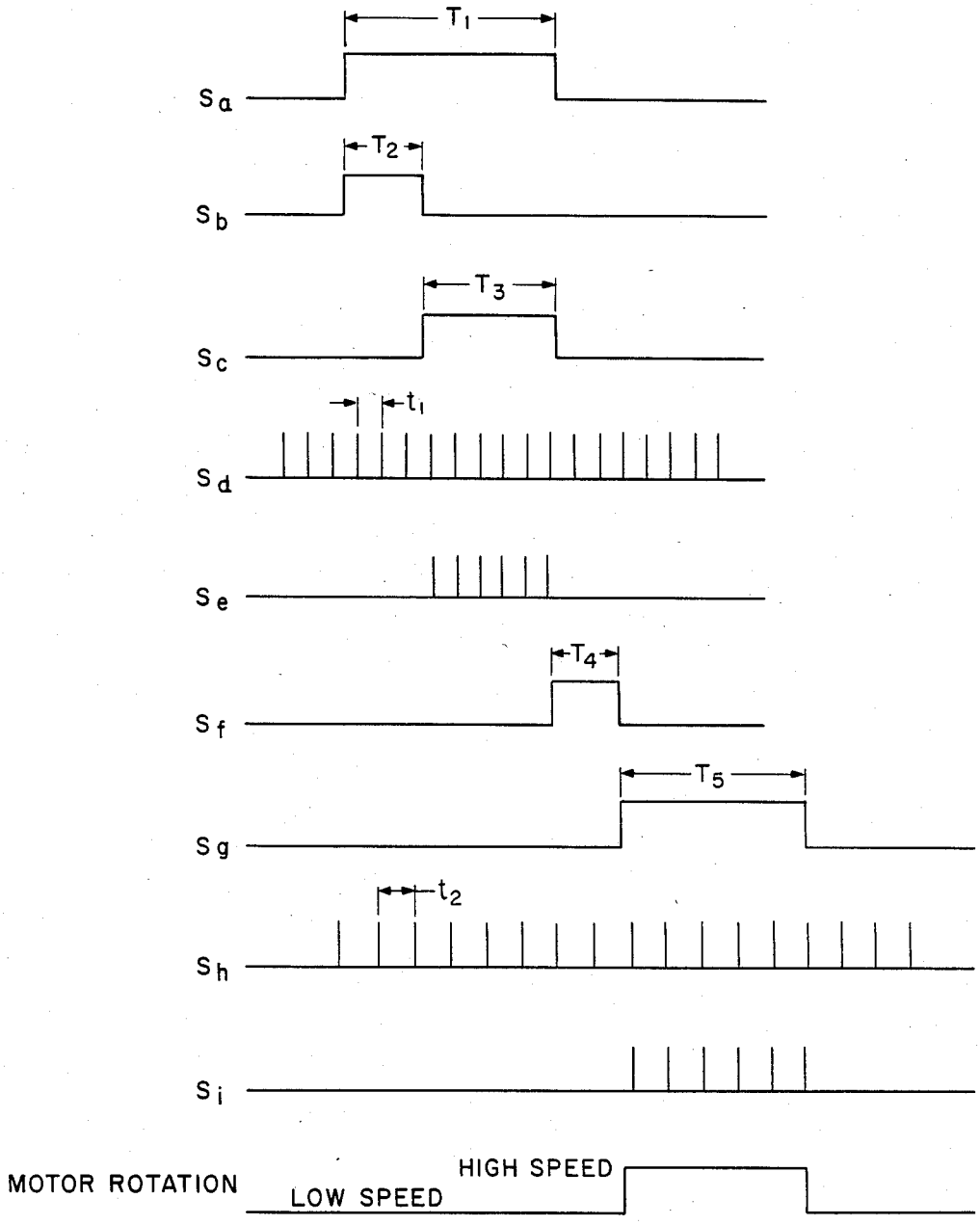
FIG. 5 shows the waveforms of signals appeared at various portions of the control unit shown in FIG. 4.

The control of the high-speed operations of the interval correction roller 7 and the suction belt 3 will now be described with reference to a control circuit shown in FIG. 4 and a timing chart shown in FIG. 5. When the light from the light source **9*a* is intercepted by the flat article, a zero level output signal is derived from an amplifier 13 connected to the detector 9*b*. When the light from the light source 9*a* enters the photoelectric conversion element 9*b*, the level of an output from the amplifier 13 becomes "1". Therefore, when the interval is detected between two adjacent flat articles being fed, the output "1" corresponding to the interval between the flat articles is derived from the amplifier 13, i.e., the output "1" of a period $T_1$ is produced as a signal $S_a$ shown in FIG. 5. This signal $S_a$ is applied to a mono-multivibrator 14. When the waveform of the signal $S_a$ rises, i.e., at the moment when the rear end of the flat article passes the detector 9, a signal $S_b$ having a period $T_2$ is derived from the mono-multivibrator 14 and supplied through an inverter 15 to an AND-circuit 16. The AND-circuit 16 also receives the signal $S_a$. The period $T_2$ of the signal $S_b$ generated in the multivibrator 14** corresponds to the minimum interval $L_{min}$ which is predetermined. The period $T_2$ and the minimum interval $L_{min}$ have the following relationship:

$$T_2 = L_{min}/V_c$$

$V_c$: Speed of the transfer belts

The period $T_3$ of an output $S_c$ derived from the AND-circuit 16 corresponds to the redundant time in the mechanical processing operation. Such a time is unnecessary for improving the processing efficiency.

A clock pulse $S_d$, having an extremely short cycle period $t_1$ as compared with the period $T_2$ of the signal $S_b$, is generated from a clock oscillator 17 and supplied to an AND-circuit 18, which also receives the output $S_c$ from the AND-circuit 16. The number of clock pulses $S_e$ derived from the AND-circuit 18 are counted in a counter 19. In the meantime, the output signal $S_c$ from the AND-circuit 16 is supplied to a monomultivibrator 20. When this input signal $S_c$ falls, i.e., at the moment when a front end of the flat article passes the detector 9, a signal $S_f$ having a period $T_4$ is derived from the mono-multivibrator 20. When the signal $S_f$ falls, a second mono-multivibrator or flip-flop 21 is set, so that the flip-flop 21 gives an output signal "1". The period $T_4$ corresponds to the time, which starts when the front end of the flat article passes the detector 9 and ends when the front end of the article is held between the interval correction roller 7 and idler roller 8.

A clock pulse train $S_h$ having a cycle period $t_2$ is derived from a clock pulse oscillator 22. The period $t_2$ is predetermined by the following calculation equation:

$$t_2 = (Vc/V_1 - Vc) \times t_1$$

where, $V_1$ is the peripheral speed of the interval correction roller 7 at such time as the roller 7 is rotated at the high speed, i.e., at such time as the interval between two flat articles is corrected.

The clock $S_h$ and an output signal $S_g$ derived from the flip-flop 21 are supplied to an AND-circuit 23. Only when the output from the second mono-multivibrator flip-flop 21 is "1", the clock pulse $S_h$ passes through the AND-circuit 23 to give an output pulse train $S_i$.

The number of pulses in this clock pulse train $S_i$ is counted by a counter 24. A comparator 25 compares the contents of the counters 19 and 24, and produces a reset signal for the counters 19 and 24 and the second mono-multivibrator or flip-flop 21 when the numbers counted by these counters 19 and 24 are equal with each other.

Consequently, a signal $S_g$ having a period $T_5$ is derived from the second mono-multivibrator or flip-flop 21. Since the numbers of clock pulses counted in the counters 19 and 24 are equal, and since $T_3/t_3=T_5/t_2$, the period $T_5$ can be indicated by the following equation:

$$T_5=(Vc/V_1-Vc)\times T_3$$

where, the period $T_5$ must be equal to or smaller than $l/V_1$ (l is the length of the smallest processable mail).

The signal $S_g$, having the period $T_5$, is supplied to a command voltage generating circuit 26 which derives therefrom a command voltage that is applied to a servomotor driving circuit 27. Responsive thereto, the servomotor $M_1$ operates at the high speed $V_1$, during the period $T_5$. As a result, the servomotor $M_1$ is rotated at the high speed for the mentioned period $T_5$. Accordingly, a correction amount ($\Delta L$) can be indicated in accordance with the following equation:

$$\Delta L=(V_1-Vc)\cdot T_5=Vc\cdot T_3$$

where, the value $Vc\cdot T_3$ is a difference between the detected interval and the minimum interval between the two adjacent flat articles.

Therefore, when the detected interval is longer than the minimum interval desired between adjacent articles, that interval is corrected to become the minimum interval.

The above is a description of the operation of the interval correction roller 7. The operation of the suction belt 3 is substantially identical with that of the interval correction roller 7. The speed of the suction belt 3 is set to the speed equal to the peripheral speed $V_1$ of the interval correction roller 7. During the high speed operation period, the suction belt 3 can be moved at the high speed $V_1$ when the output signal $S_g$ derived from the flip-flop 21 is supplied to a command voltage generating circuit 26' and to a servomotor driving circuit 27' for a servomotor $M_2$, which is used to drive the suction belt 3. Consequently, the position of the flat article clinging to the suction belt 3 is corrected by $\Delta L$, i.e., $V_c\cdot T_3$, and the article is then sent out into the transport path.

Figure 3:
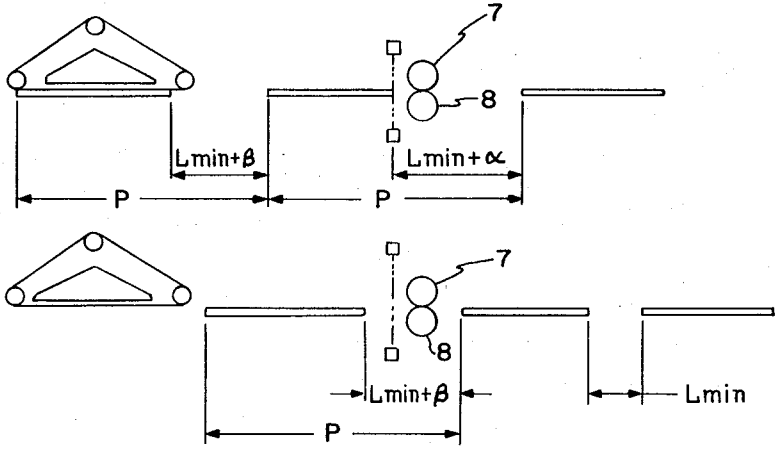
FIG. 3 is a schematic diagram showing an operation for correcting intervals between adjacent flat articles in the first embodiment shown in FIG. 2.

Thus, the flat article clinging to the suction belt 3 is positionally corrected by an amount which is equal to the amount, by which the preceding flat article was corrected responsive to an operation of the interval correction roller 7. Accordingly, when a plurality of flat articles are sent to the interval correction roller 7 a distance between the rear ends of two adjacent flat articles is kept constant or equal to a distance p (FIG. 3) between the suction bores provided in the suction belt 3. The correction of the interval between two adjacent flat articles can always be made without delay, so that the plurality of flat articles can be sent out from the interval correction roller 7, with a uniform minimum interval between two adjacent flat articles.

Figure 6:
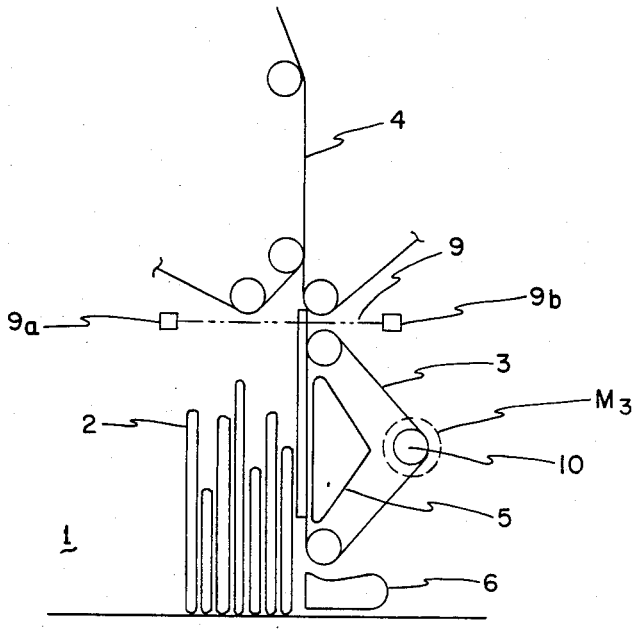
FIG. 6 illustrates a second embodiment of the present invention.

A second embodiment (FIG. 6) of the present invention will now be described. The basic construction of the second embodiment shown in FIG. 6 is similar to that of the flat article feeding apparatus shown in FIG. 1. Namely, the second embodiment is formed by adding a flat article detector 9 to the conventional feeding apparatus shown in FIG. 1.

Unlike the first embodiment, the second embodiment does not have a the interval correction roller. A motor $M_3$ drives a suction belt 3 via a roller 10. The motor operates at a speed which can be changed from a normal speed $V_c$ to a lower speed $V_2$. In the second embodiment, the belt 3 is adapted to pickup a flat article and to send it out. The speed of the suction belt is set to a value, in which the smallest flat article to be processed can be fed so that a desired minimum interval is kept between this article and the smallest preceding article likely to be encountered. The minimum distance is that permitted by a subsequent process.

Assuming Q to a distance between rear ends of two adjacent flat articles being sent out, and l to the length of the smallest flat article, Q is indicated as $Q=l+L_{min}$. The suction belt 3 is normally driven at the speed $V_c$, which is equal to the speed of the flat article in a transport path 4. The speed $V_c$ of the suction belt 3 is set by taking the smallest flat article into consideration. When a flat article longer than l actually is encountered, the speed of the suction belt 3 is changed to the lower speed $V_2$ for a certain period of time to set the minimum interval $L_{min}$ between this article and the preceding article.

Figure 7:
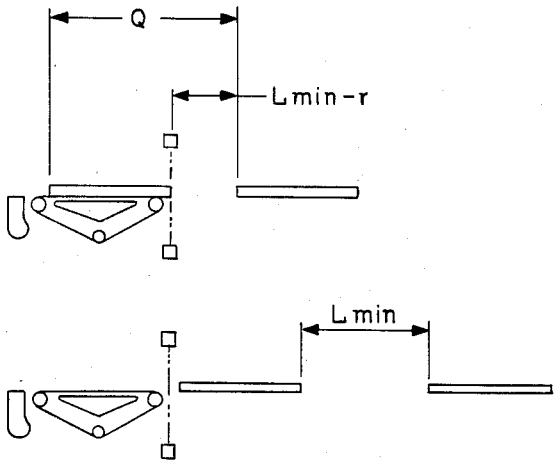
FIG. 7 is a schematic diagram showing an operation for correcting intervals beween adjacent flat articles in the second embodiment shown in FIG. 6.
Figure 8:
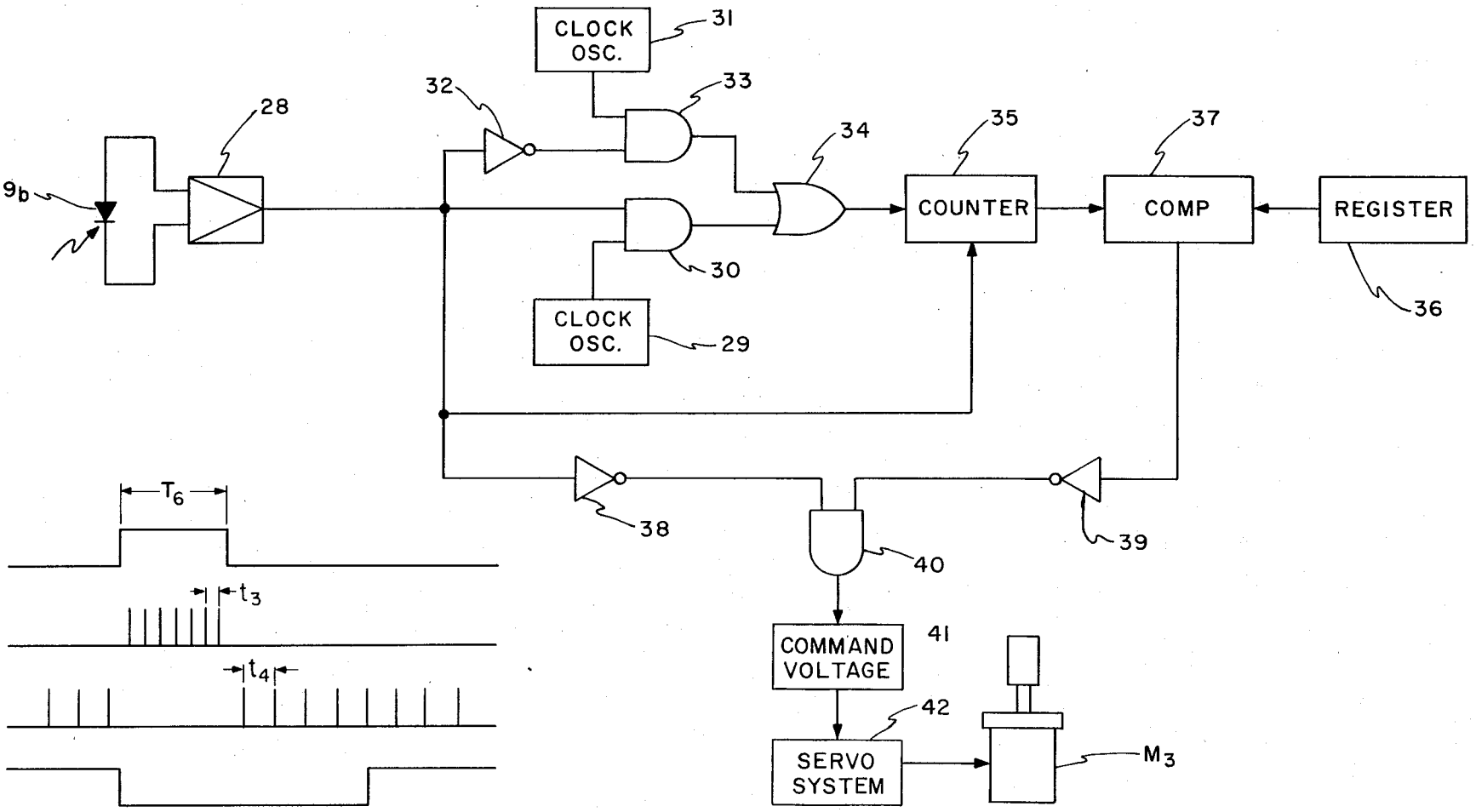
FIG. 8 is a block diagram of a control unit in the second embodiment shown in FIG. 6.
Figure 9:
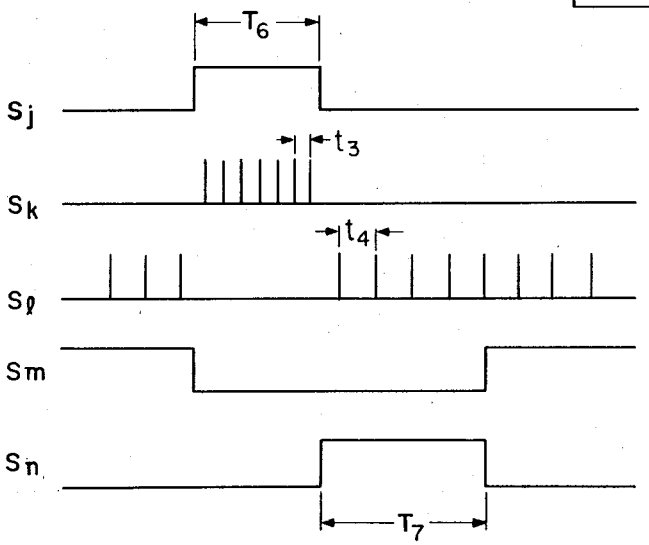
FIG. 9 shows the waveforms of signals appeared at various portions of the control unit shown in FIG. 8.

The operation of a system for controlling the motor $M_3$ driving the suction belt 3 in the second embodiment will now be described with reference to FIGS. 7, 8 and 9. Referring to FIG. 7, when an interval between two adjacent flat articles is detected, an output signal from an amplifier 28 (FIG. 8) has a logic level "1" for a period of time $T_6$ (FIG. 9), which corresponds to the interval. The signal $S_j$ having a pulse width $T_6$ is the output of the amplifier 28. A clock pulse having an extremely short period $t_3$ is derived from a clock oscillator 29 and is applied along with the output signal $S_j$ from the amplifier 28 to an AND-circuit 30. Accordingly, the output clock pulse from the AND-circuit 30 occurs only while the interval between the flat articles is being detected by the detector 9. This output from the AND-circuit is represented by the pulse train $S_k$. The number $n_1$ of the output clock pulses can be calculated by the equation, $n_1=T_6/t_3$.

On the other hand, a clock pulse having a cycle period $t_4$ is derived from a clock oscillator 31. The period $t_4$ can be predetermined in accordance with the following equation:

$$t_4=(Vc/Vc-V_2)\times t_3$$

where, $V_2$ is the speed of the suction belt 3 during a low-speed operation thereof, i.e., an operation for correcting the interval between the rear end of the preceding flat article and the front end of the subsequent flat article; and $V_c$ is the speed of the suction belt 3 during the normal operation thereof.

The polarity of an output signal $S_j$ from the amplifier 28 is reversed in an inverter 32. The inverted output signal and the clock pulse derived from the clock oscillator 31 are supplied to an AND-circuit 33. Accordingly, while the light from a light source 9a is intercepted by the flat article, the clock pulse having the period $t_4$ is passed from the AND-circuit 33. This output pulse train is represented by $S_l$. Both the output pulse trains $S_k$ and $S_l$ are supplied to an OR-circuit 34. The number of pulses derived from the OR-circuit 34 is counted by a counter 35. Further, the content of the counter 35 is reset, i.e., set to "0" when the signal $S_j$ is changed from "0" to "1", i.e., when the rear end of the flat article passes the detector 9. A number N, which can be calculated in accordance with the following equation, is previously stored in a register 36.

$$N=(L_{min}/V_c)\cdot(1/t_3)$$

The contents of the counter 35 and the register 36 are compared in a comparator 37. When the number in the counter 35 is equal to or greater than that in the register 36, a logic level "1" is the output from the comparator 37. When the number in the counter 35 is less than that in the register 36, a logic level "0" is the output therefrom. This output is represented by signal $S_m$ (FIG. 9).

On the other hand, the signals $S_j$ and $S_m$ pass through different inverters 38 and 39, respectively, and the inverted signals are then supplied to an AND-circuit 40. Consequently, a signal $S_n$ having a period $T_7$ is derived from the AND-circuit 40 and is supplied to a speed command voltage generating circuit 41, for the servomotor $M_3$. During only the period $T_7$, the command voltage for the low speed operational mode is applied from the command voltage circuit 41 to a servomotor driving circuit 42 to cause the servomotor $M_3$ to operate at the low speed. Thus, the suction belt 3 is moved at the low speed only during the period $T_7$.

The time period $T_7$ can be expressed by the equation, $T_7=(N-n_1)\cdot t_4$. Since the speed of the suction belt 3 is reduced, it can be said that the interval between the rear end of the preceding flat article and the front end of the subsequent flat article has been corrected by $\gamma$, which can be indicated by the following equation:

$$\gamma=(V_c-V_2)\cdot T_7=(N-n_1)(V_c=V_2)\cdot t_4,$$

and $$t_4=(V_c/V_c-V_2)\cdot t_3,\ N=(L_{min}/V_c)\cdot(1/t_3),\ n_1=T_6/t_3$$

Therefore, the following equation can be obtained:

$$\gamma=L_{min}-T_6\cdot V_c$$

Namely, the correction amount $\gamma$ is equal to a difference between the minimum interval $L_{min}$ and the actual detected interval. Consequently, the interval between two adjacent flat articles is always kept at the minimum interval $L_{min}$, according to the present invention.

In the above-described embodiments, the interval between two adjacent flat articles is corrected by changing either the speed of the suction belt and the interval correction roller, or the speed of the suction belt alone. Also, it may readily be understood that the above described interval correction operation is carried out by either a method using a combination of a speed increase and speed decrease, or a method, in which the speed of the suction belt and/or the correction roller is increased or decreased in a plurality of steps. Furthermore, in order to improve the interval correction accuracy, a plurality of detectors and correction means may be provided along the flat article transport path. According to the present invention, the distance between the front ends of adjacent flat articles can easily be kept constant by modifying the embodiments in addition to the interval correction.

As described above, the present invention enables a feeding, one by one of a plurality of flat articles while correcting the interval between two adjacent flat articles to maintain the constant and minimum distance, thus making a flat article handling apparatus most efficient.

What is claimed is:

1. A flat article feeding apparatus comprising:

a suction chamber having a front surface;

a suction belt having suction bores for successively picking up individual ones of a plurality of flat articles which are stacked in a vertically standing state, said suction belt moving along the front surface of said suction chamber to evacuate and create a suction in said bores;

transport path means for transferring the flat article delivered from said suction belt;

means located at an upstream portion of said transport path means for detecting the intervals between flat articles being delivered from said suction belt to said transport path means;

a first motor for driving said suction belt, said first motor being capable of varying its rotational speed between first and second speeds;

roller means located along said transport path means for making contact with the transferred flat article in said transport path means;

a second motor for driving said roller means, said second motor being capable of varying its rotational speed between a third speed and a fourth speed which is higher than said third speed;

means for varying the rotational speeds of said first and second motors in response to the interval detected by said detecting means to set said interval constant;

means responsive to said detecting means detecting an interval between two adjacent flat articles which interval is longer than a predetermined interval for changing the rotational speed of said second motor from said third speed to said fourth speed during a period corresponding to the difference between the detected interval and said predetermined distance; and means for changing the rotational speed of said first motor from said first speed to said second speed during said period.

2. A flat article feeding apparatus comprising:

a suction chamber having a front surface;

a suction belt having suction bores for successively picking up individual ones of a plurality of flat articles while they are stacked in a vertically standing state and for successfully delivering said picked up articles to a succeeding station, said suction belt moving along the front surface of said suction chamber where said bores are evacuated to create a suction;

means for detecting the spacing intervals between the flat articles as they are delivered from said suction belt;

a variable speed motor for driving said suction belt, in which said rotational speed of said motor is varied in accordance with said interval detected by said detecting means;

said motor varying its rotational speed between first and second speeds, the first speed propelling the smallest flat articles to cause a predetermined space interval between said smallest flat articles, said second speed being lower than said first speed; and means for changing said rotational speed of said motor from said first speed to said second speed during a period corresponding to the difference between said predetermined interval and an interval detected by said detecting means.

3. A delivery system comprising storage means containing a stacked plurality of flat articles of varigated length to be picked up and delivered one by one to a distant location, a running suction belt means for cyclically and sequentially picking up one at a time the outermost one of said stacked plurality of flat articles and for carrying said picked up flat articles along with said running section belt means, the running suction belt means sequentially delivering each flat article to other equipment at an output of said suction belt means, the delivery rate inherently varying with the lengths of the flat articles so that enough space must be provided between the flat articles to prevent an overlapping between two of the longest deliverable flat articles, detector means for detecting a passage of leading and trailing ends of each of said flat articles as they are being delivered to said other equipment whereby the detector finds an interval between the trailing edge of one flat article and the leading edge of the next uncoming flat article, and delivery speed control means located adjacent the output of said suction belt means and operated responsive to said detector means for selectively accelerating or decelerating individual ones of said flat articles to establish a predetermined minimum interval distance between successive ones of said flat articles regardless of their length whereby a maximum number of said flat articles are packed into a minimum amount of transport space in said delivery system.

4. The system of claim 3 wherein said delivery speed control means is an accelerating means comprising a driven roller working against an idler wheel at a location near the output of said suction belt means so that it delivers said flat articles into the nip of said roller and idler wheel.

5. The system of claim 4 and control means responsive to said detector means for generating a command voltage control pulse having a period which corresponds to the difference between said predetermined minimum interval and the actual physical spacing between said flat articles as they are delivered from the output of said suction belt means into said nip of the roller and idler wheel, and means responsive to said control pulse for driving said driven roller for the duration of the period of said control pulse.

6. The system of claim 5 wherein said other equipment is a running pair of confronting pickup belts for holding said flat articles between them with a predetermined friction, and spring bias means for pressing said driven roller against said idler with a force which overcomes said predetermined friction.

7. The system of claim 5 and means responsive to said control pulse for increasing the speed of said running suction belt means for the duration of the period of said control pulse.

8. The system of claim 7 wherein the peripheral speed of said driver roller and said suction belt means are the same for the duration of said period.

9. The system of claim 3 wherein said delivery speed control means is a decelerating means comprising a running pair of confronting pick up means, said pick up belt means being located at a point where said suction belt means delivers said flat articles into the nip between said pick up belt means, means for normally driving said suction belt means and said pick up belt means at the same peripheral speed, and means for momentarily slowing said suction belt means to momentarily delay the delivery of said flat article into the nip between said pick up belts.

10. The system of claim 9 and control means responsive to said detector means for generating a command voltage control pulse having a period which corresponds to the difference between said predetermined minimum interval and the actual physical spacing between said flat articles as they are delivered from the output of said suction belt means, and means responsive to said control pulse for slowing said suction belt means for the duration of said period.

* * * * *